US005279727A

United States Patent [19]

Helstrom et al.

[11] Patent Number: 5,279,727

[45] Date of Patent: Jan. 18, 1994

[54] OPEN-BOTTOMED CYCLONE WITH SOLIDS SEPARATION TUBE AND METHOD

[75] Inventors: John J. Helstrom, Naperville; John M. Forgac, Elmhurst, both of Ill.

[73] Assignee: Amoco Corporation, Chicago, Ill.

[21] Appl. No.: 815,286

[22] Filed: Dec. 27, 1991

[51] Int. Cl.[5] ..... C10G 11/00; F27B 15/09

[52] U.S. Cl. ..... 208/161; 208/113; 208/153; 422/147

[58] Field of Search ..... 208/113, 153, 161; 422/147

[56] References Cited

U.S. PATENT DOCUMENTS

| | | | |
|---|---|---|---|
| 2,687,780 | 8/1954 | Culhane | 183/22 |
| 3,448,563 | 6/1969 | Sobeck | 55/347 |
| 4,350,510 | 9/1982 | Hamada et al. | 55/349 |
| 4,478,708 | 10/1984 | Farnsworth | 208/161 |
| 4,891,129 | 1/1990 | Barnes | 208/161 |
| 4,904,281 | 2/1990 | Raterman | 55/1 |
| 5,112,576 | 5/1992 | Kruse | 422/144 |

*Primary Examiner*—Mark L. Bell
*Assistant Examiner*—Walter D. Griffin
*Attorney, Agent, or Firm*—Scott P. McDonald; Richard A. Kretchmer

[57] ABSTRACT

Open-ended cyclone separators are disclosed which employ catalyst separation tubes to prevent separated solids discharged through an open cyclone end from being entrained in a countercurrently moving flow of process gas entering the separator through the open end. In several preferred embodiments, generally conical tubes are axially located within the cyclone open bottom. Methods for practicing the invention also are disclosed.

6 Claims, 2 Drawing Sheets

OPEN-BOTTOMED CYCLONE WITH SOLIDS SEPARATION TUBE AND METHOD

The subject matter of this application is related to the subject matter contained in an application entitled "Open-Bottomed Cyclone With Gas Inlet Tube and Method", U.S. Ser. No. 07/815,281, also filed on Dec. 27, 1991.

FIELD OF THE INVENTION

The invention relates to methods and apparatus useful for separating solids from a mixture of gases and solids. More particularly, the invention relates to open-bottomed cyclone separators employing solids separation tubes to direct a process gas up through the open cyclone bottom without entraining countercurrently moving solids discharged through the open cyclone bottom.

BACKGROUND OF THE INVENTION

Efficient use of petroleum feedstock typically requires a refiner to convert relatively high molecular weight hydrocarbons to more valuable lower molecular weight gasoline range hydrocarbon materials. Catalytic cracking is one process used to produce the more valuable gasoline range materials.

Modern catalytic cracking processes typically react hydrocarbon vapors with a hot zeolitic cracking catalyst in a fluidized riser reactor. The cracking reaction proceeds as the catalyst and feedstock rise through the reactor, with a reaction mixture of predominantly spent catalyst and lower molecular weight hydrocarbons being discharged from the upper end of the reactor. After rising through the reactor, spent catalyst must be separated from the reaction mixture so that the cracked hydrocarbon products can be further processed and so that spent catalyst can be regenerated and reused.

In older "open" style catalyst disengagement systems, an initial solids separation typically is accomplished by causing a radical change in direction of reaction mixture flow. In such a system, the linear momentum of the catalyst particles forces the particles to impact on a surface near the point of flow redirection, thereby causing the particles to lose their momentum and fall from the mixture. At the same time, the relatively momentumless hydrocarbon vapors successfully negotiate the change in flow path direction and proceed through the system for further solids separation.

In these "open" systems, the solids-depleted gases are released into a large disengagement vessel which surrounds the riser reactor and contains one or more closed-bottomed cyclone separators, or "cyclones". The cyclones withdraw vapors from the vessel volume and cyclonically separate solids not removed in the initial disengagement step. After separating most of the solids from the withdrawn gas, the cyclones discharge a further solids-depleted gas along a closed vapor path leading out of the vessel.

At the same time that solids-depleted gas is discharged into the vessel, spent catalyst separated in the initial disengagement step accumulates in the bottom portion of the vessel as a dense bed of catalyst. The bed is stripped of entrained hydrocarbon vapors by passing stripping steam through the bed, thereby releasing a mixture of stripped vapors and stripping steam, or "stripping gas", into the vessel volume located above the dense bed. The stripping gas entering the vessel volume is drawn into the cyclones along with the solids-depleted gas from the initial separation step.

The "open" style system just described provides the additional advantage of damping pressure and catalyst surges known to occur in catalytic cracking riser reactors. Causes of these surges include equipment malfunctions and the sudden vaporization of water present in feedstock, as well as various unit pressure upsets. Because these riser surges are damped into the large vessel volume before the reaction products enter the secondary separation equipment, the surges do not degrade the separation efficiency of downstream devices as they otherwise would if not damped into the vessel volume. Examples of such "open" systems can be found in U.S. Pat. No. 4,500,423.

Unfortunately, the older "open" style system has been found to contribute to the undesired secondary thermal cracking of gasoline range materials when operated in the 1000 degree plus Fahrenheit temperature range common in modern catalytic cracking units. Because the cracked products mix with the large vessel volume before being withdrawn from the vessel by the secondary separation equipment, the cracked products can reside in the vessel long enough at high enough temperatures to significantly affect product yield. For example, estimates show that as much as ten percent of the desired gasoline range products can be lost if these products are exposed to temperatures of 1100° F. for as little as 4 to 5 seconds.

To prevent undesired secondary thermal cracking, some refiners have turned to "closed" systems in which reaction products pass along a closed vapor path from a riser reactor to subsequent catalyst disengagement steps. By moving cracked vapors along a closed vapor path, the increased gas residence times caused by mixing cracked products into a large disengagement vessel volume is avoided.

While closed systems succeed in minimizing gas residence times and the associated undesired thermal cracking of reaction products, closed systems can suffer from an inability to mitigate the effects of pressure and catalyst surges. Specifically, because surges no longer vent into a large disengagement vessel volume, surges typically propagate into the cyclone, disturbing the cyclonic motion of materials inside the cyclone. This in turn reduces the cyclone's separation efficiency.

One method of dealing with unwanted surges in closed systems is to employ a mechanical solution such as the surge activated trickle valves disclosed in U.S. Pat. No. 4,581,205. This method permits surges to be vented into a large vessel volume, but is undesirable because it increases the mechanical complexity of the separation equipment and because it requires the continued operation of mechanical devices in the thermally severe and erosive catalytic cracking environment.

A more desirable solution to surge and secondary cracking problems is to employ an "open-bottomed" cyclone design as disclosed by Farnsworth in U.S. Pat. No. 4,478,708, the disclosure of which is hereby incorporated by reference. In this design, catalytically-cracked products and spent catalyst follow a closed vapor path into a cyclone having a bottom which opens into a relatively large disengagement vessel volume. Catalyst is cyclonically separated in the cyclone in much the same manner as in other cyclones well known in the art, but instead of falling into a dipleg, separated catalyst simply falls through the open cyclone bottom into the lower portion of the disengagement vessel for stripping and collection. Catalyst-depleted gas is withdrawn from the top of the cyclone and is passed through secondary separation cyclones as in many traditional closed-bottomed cyclone systems.

Farnsworth's design apparently succeeds because the lower pressure downstream of his open-bottomed cyclone causes the cyclone to appear to be a closed vapor path for gases even though the bottom of the cyclone is open. Only when cyclone inlet pressure increases significantly, such as under surge conditions, does the open bottom offer a vapor path into the large disengagement volume. Thus, Farnsworth's design represents an apparent improvement over the other designs already discussed.

While Farnsworth's open-bottomed cyclone design provides a partial solution to the surge and secondary cracking problems inherent in closed-vapor path catalytic cracking operations, his design suffers from a serious disadvantage that stems from the use of the open-bottomed cyclone. Specifically, while separated catalyst is falling downward toward the open bottom, stripping gas simultaneously must flow up into the cyclone's open bottom. The countercurrent flow of catalyst and vessel vapors can cause separated catalyst to become entrained in the stripping gas, thereby reducing the efficiency of the separator.

Until now, those skilled in the art have not recognized the problem of open-bottomed cyclone solids reentrainment. Instead, work to improve cyclone separators primarily has been directed toward improvements in the more traditional "closed-bottomed" cyclone designs. For example, Baillie, U.S. Pat. No. 4,081,249 teaches that closed-bottomed cyclone catalyst attrition can be reduced through the use of a collection of arresting vanes, flow reversing plates and baffles within the cyclone.

Other work by Baillie disclosed in U.S. Pat. No. 4,486,207 teaches that particle attrition can be reduced through the use of multiple cyclone inlets. The use of these multiple inlets permits increased cyclone throughput without increasing tangential wall velocity.

Parker, U.S. Pat. No. 4,455,220 discloses a combined cyclonic separation and stripping system in which a cyclonic separator is located directly over a stripping section and within a single closed vertical conduit. Parker employs a vortex stabilizer between the cyclonic and stripping sections to improve cyclone performance. It should be noted that Parker's design forces catalyst and stripped vapors to travel in a countercurrent manner between the stabilizer and the inner conduit wall housing the stabilizer, thereby also permitting entrainment of downwardly moving solids in the vapors moving upwardly from the stripping zone.

Kruse, allowed U.S. Ser. No. 07/529,204, also teaches the use of a cyclone separator located directly above a stripping zone within a single closed vertical conduit. Unlike Parker, Kruse employs a cone having an aperture at its apex to direct stripping gases along the longitudinal axis of his conduit. As with Parker, Kruse's invention essentially is a closed cyclone design intended for use outside of a disengagement vessel, and appears to have a region of countercurrently moving catalyst and stripping gas near the conduit wall.

None of the cyclone designs discussed above provide for a mechanically simple cyclone design which can accommodate pressure and catalyst surges while at the same time minimizing entrainment of downwardly moving catalyst in upwardly moving stripping gas entering the separator through the open cyclone bottom.

SUMMARY OF THE INVENTION

It is an object of the invention to provide an improved cyclone design for separating solids from a mixture of solids and gases.

It is another object of the invention to provide a cyclone design which provides an effectively closed vapor path between a riser reactor and another downstream component such as a secondary cyclone.

It is a further object of the invention to provide a cyclone separator which can accommodate pressure and catalyst surges.

It is yet another object of the invention to provide a cyclone separator which can admit stripping gas through an open cyclone bottom while at the same time discharging solids through the open bottom without entraining the discharged catalyst in the entering stripping gas.

It is still another object of the invention to provide an improved openbottomed cyclone of mechanically simple design.

Other objects of the invention will become apparent as discussed hereafter.

The aforestated objects of the invention can be accomplished by providing a cyclone separator for separating solids from a mixture of solids and gas which includes a separation chamber having an open first end, a radially symetric wall member extending from the first open end to a second chamber end, and a chamber end member connected to the wall member at the second chamber end for enclosing the second end of the chamber; gas withdrawal means for withdrawing a solids-depleted gas from a solids-depleted central region of the chamber; cyclonic flow generating means for creating a cyclonic flow of mixture within the chamber, thereby causing cyclonically rotating solids to separate from the mixture and rotate towards the open first chamber end in a solids-rich region near the chamber wall member; and solids separation means for preventing separated solids discharged from the open chamber end from becoming entrained in a process gas entering the open chamber end.

The solids directing structure limits entrainment of solids in the process gas by providing a solids separation tube preferably located concentrically within an open cyclone bottom which isolates the countercurrently moving streams of process gas and separated solids. Solids exiting the cyclone flow outwardly around an outer surface of the tube while the process gas flows into the open cyclone bottom through the tube. In preferred embodiments, the tube is generally conical in shape and may include structure for disengaging solids flow adhereing to the cone.

Heretofore, it has not been recognized that open-bottomed cyclone performance can be improved by adding flow-directing structure within the cyclone open bottom. By using a solids separation tube to direct separated solids flow and a countercurrent stripping flow within different regions of the cyclone open bottom, improved cyclone performance can be obtained.

DETAILED DESCRIPTION OF THE INVENTION

FIGS. 1–6 illustrate various embodiments of an open-bottomed cyclone in accordance with the present invention. In each FIGURE, like numbers refer to like parts. Each embodiment includes a solids-directing tube or cone for directing catalyst particles out of an open-bottomed cyclone separator, thereby minimizing entrainment of cyclonically separated catalyst particles in the countercurrent flow of stripping gas entering the separator through the open bottom. While FIGS. 1–6 illustrate several structures particularly useful for catalyst disengagement in catalytic cracking operations, it should be understood that the invention is not limited to these particular embodiments or specifically to catalytic cracking operations, as the invention can be used wherever separated solids are discharged through an open end of a cyclone separator countercurrent to a flow of a process gas entering the separator through the open separator end.

Figure 1:
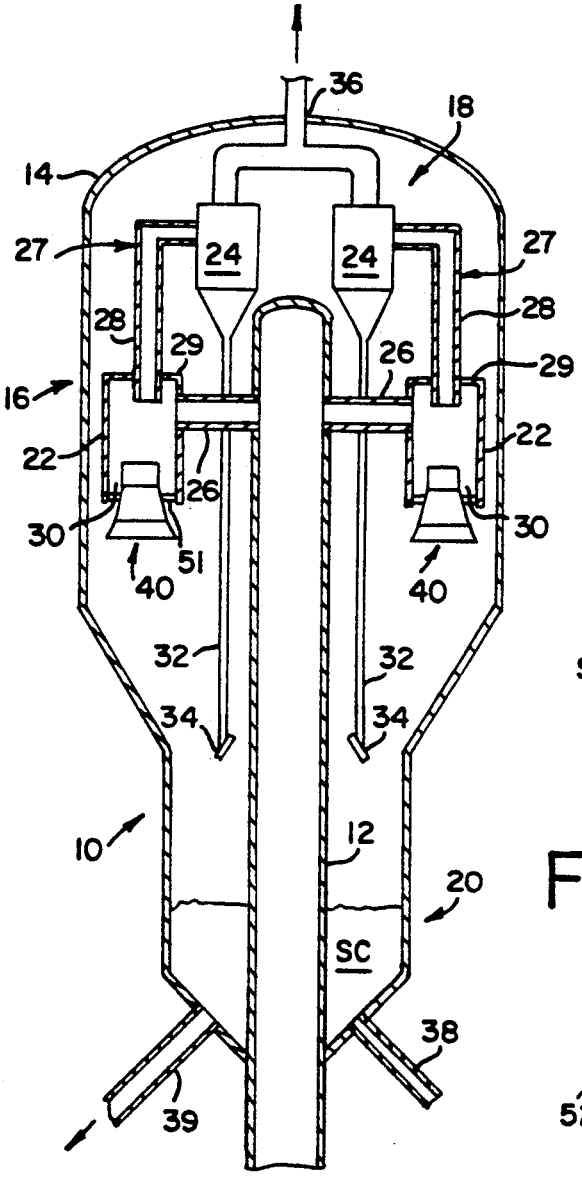
FIG. 1 is a sectional view of a catalytic cracking riser reactor and associated disengagement equipment including an open-bottomed cyclone with a preferred catalyst separation cone in accordance with the present invention.

Referring first to FIG. 1, a catalytic cracking reactor 10 includes a riser reactor 12 located generally along the longitudinal centerline of a disengagement vessel 14. During operation, hot catalyst and relatively high molecular weight hydrocarbon feedstock is introduced at or near the bottom of reactor 12. The hot catalyst vaporizes the hydrocarbon feedstock and the mixture is propelled upward through reactor 12 as a fluidized bed. The feedstock and catalyst react while rising through reactor 12, being converted to a reaction mixture of predominantly spent catalyst and cracked hydrocarbon vapors by the time these materials reach the upper end of reactor 12.

Vessel 14 has a relatively large diameter upper region 16 containing various catalyst disengagement equipment 18 in accordance with the present invention and a relatively smaller diameter lower portion 20 in which spent catalyst SC accumulates as discussed below. As illustrated, disengagement equipment 18 includes a pair of open-bottomed cyclones 22, a pair of closed-bottomed secondary cyclones 24, reactor discharge pipes 26 for providing a closed vapor path between reactor 12 and open-bottomed cyclones 24, and open-bottomed cyclone outlet pipes 27 including separator finder tube member 28 extending through a chamber top 29 for providing a closed vapor path between cyclones 22 and cyclones 24.

Following the catalytic cracking process, spent catalyst and cracked hydrocarbon vapors are discharged from reactor 12 through tubes 26 and pass into cyclones 22. Cyclones 22 cyclonically separate solid catalyst from the reaction mixture RM, causing spent catalyst SC to fall through cyclone open bottoms 30 toward lower vessel region 20. Solids-depleted gas from cyclones 22 exits cyclones 22 through gas outlet pipes 28 and enters closed-bottomed cyclones 24 for additional solids separation. Solids separated by cyclones 24 falls into diplegs 32, where the solids accumulate until trickle valves 34 release the accumulated solids into lower vessel region 20. Alternatively, diplegs 32 can be submerged in accumulated spent catalyst SC as is well known in the art. Catalyst-depleted vapors HV exit cyclones 24 and vessel 14 through vapor outlet header 36, and pass to a fractionating tower (not shown), where the hydrocarbon vapors are collected by condensation.

Because spent catalyst separated by cyclones 22 and 24 contains a significant quantity of entrained hydrocarbon vapors, stripping steam supplied by a steam line 38 is passed through accumulated spent catalyst SC to strip hydrocarbon vapors from catalyst SC. The steam and stripped hydrocarbon vapors, hereafter collectively referred to as stripping gas SG, pass into upper region 16 of vessel 14. Stripped spent catalyst can be removed through catalyst removal line 39 for regeneration and reuse.

Figure 2:
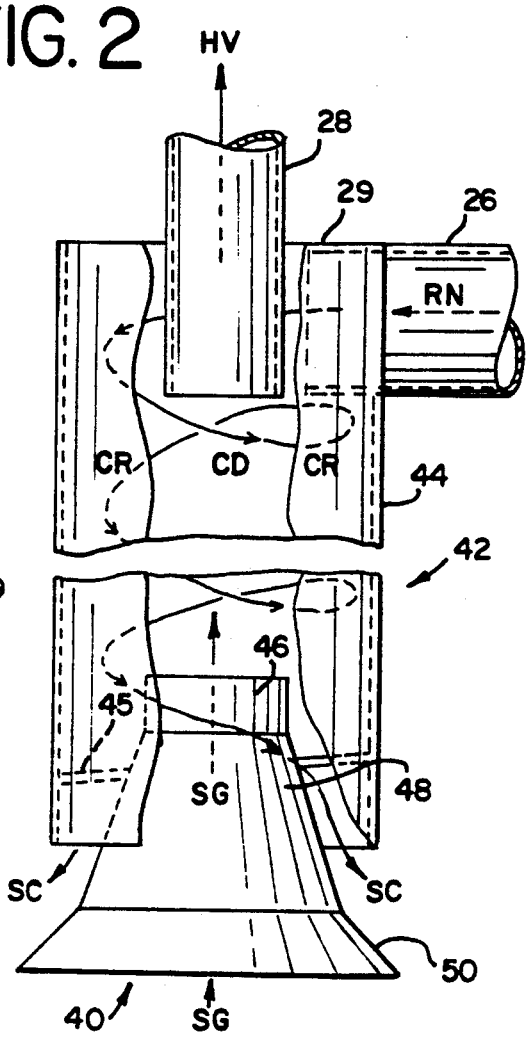
FIG. 2 is an elevational view of the open-bottomed cyclone shown in FIG. 1.

Stripping gas SG discharged into upper vessel region 16 is drawn into open-bottomed cyclones 22 through generally conical catalyst separation cones 40 as described in detail in conjunction with FIG. 2. Stripping gas SG mixes with the catalyst-depleted vapors HV leaving cyclones 22 and is processed through closed-bottomed cyclones 24 and discharged from vessel 14 through header 36.

The operation of open-bottomed cyclone separator 22 is best discussed while viewing FIG. 2. Reaction mixture RM is discharged from reactor discharge pipe 26 into a generally cylindrical separation chamber 42. The geometry of pipe 26 and chamber 42 is such that mixture RM is tangentially directed at a cylindrical chamber wall member 44. This orientation causes the entering reaction mixture to flow cyclonically within chamber 42. As mixture RM flows within chamber 42, the angular momentum of spent catalyst SC within the mixture causes spent catalyst SC to move into a catalyst-rich region CR near chamber wall 44. The catalyst particles continue to spin within region CR, occasionally striking wall 44 as they rotate downwardly within chamber 42 and toward catalyst separation cone 40.

Catalyst particles moving downwardly through chamber 42 encounter separation cone 40 which is supported within open bottom 30 by a plurality of cone supports 45. As shown in FIG. 2, cone 40 includes an upper conical portion 46 having a slope of almost zero with respect to the longitudinal axis of chamber 42, a middle conical portion 48 having a moderate slope with respect to the longitudinal axis of chamber 42, and a lower conical portion 50 having a greater slope than portions 46 and 48. Spent catalyst particles SC move downwardly past cone 40 and out the open chamber bottom 30. Cone 40 isolates exitting separated catalyst SC from stripping gas SG which simultaneously is being drawn into chamber 42. Care should be taken to ensure that the slope of lower portion 50 is sufficiently small to prevent solids buildup on cone 40 that is especially prone to occur during unit shutdowns. Therefore, it is preferred that the slope of portion 50 be less than the angle of repose of the material being separated so that solids will readily slide from lower cone portion 50 rather than accumulating there. It also should be understood that the configuration of cone supports 45 is not critical as long as supports 45 do not significantly interfere with the flow of spent catalyst as discussed above. If desired, supports 45 can be vaned and oriented in such a manner as to minimize disruption of cyclonic spent catalyst flow.

Hydrocarbon vapors present in reaction mixture RM generally are not subject to the momentum effects that move the relatively heavy catalyst particles into catalyst-rich region CR. As a result, the migration of catalyst towards chamber wall 44 creates a catalyst-depleted central chamber region CD located in an inner region of chamber 42 along chamber 42's cylindrical axis. The material present in region CD consists primarily of hydrocarbon vapors and catalyst fines having insufficient momentum to move towards chamber wall member 44. Because hydrocarbon vapors are condensed after they leave reactor 10, a relatively low system pressure is present at the inlet of a finder tube member 28. This low system pressure causes catalyst-depleted hydrocarbon vapor HV to be drawn from catalyst-depleted region CD into finder tube member 28.

The low system pressure drawing vapors HV from chamber 42 also draws stripping gas SG upwardly into chamber 42. The momentum of spent catalyst particles SC moving through open bottom 30 between cone 40 and wall member 44 substantially opposes stripping gas flow between cone 40 and wall member 44. This causes stripping gas SG to be drawn upward through cone 40 into catalyst-depleted central chamber region CD. Gas SG mixes with catalyst-depleted hydrocarbon vapors within region CD and is withdrawn as vapor HV from region CD through finder tube member 28.

Figure 3:
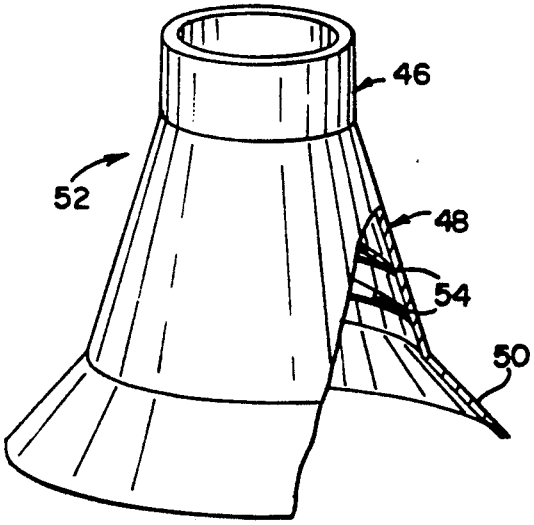
FIG. 3 is a cutaway perspective view of another embodiment of catalyst separation cone incorporating optional stripping gas swirl vanes.

FIG. 3 is a cutaway perspective view of a catalyst separation cone 52 identical in shape to cone 40 but incorporating a plurality of stripping gas swirl vanes 54. Vanes 54 impart a cyclonic flow to stripping gas SG as it moves upwardly into catalyst-depleted region CD of chamber 42. By imparting a cyclonic rotation in the same direction as the cyclonically moving mixture within the chamber, it is believed that disruption of cyclonic flow within the chamber by upwardly moving stripping gas SG can be minimized.

A generally conical separation tube shape is preferred over a cylindrical tube shape because of the cone's varying cross sectional area. Both upwardly moving stripping gas SG and downwardly moving separated catalyst SC encounter flow channels of decreasing cross sectional area and therefore decreasing pressure which favors flow in the desired directions. Similarly, undesired backflow encounters a flow path of increasing cross sectional area which yields an increased pressure which opposes the back flow.

The shape of catalyst separation cones 40 and 52 discussed in conjunction with FIGS. 1–3 are preferred over simple conical forms. The conical regions of successively increasing slope present in these cones allows upper conical region 46 to extend upwardly through the cyclonic vortex to a point near finder tube member 28 without interfering with cyclonic flow near chamber wall member 44, a result generally not obtainable with a simple conical form (see FIG. 6) This further minimizes mixing of stripping gas SG with cyclonically rotating solids as it provides a short, direct path into finder tube member 28 for stripping gas SG. In this regard, it should be noted that cones having continuously curved surfaces or formed from a plurality of flat surfaces approximating curved surfaces and similar in shape to cones 40 and 52 may also be preferred.

The catalyst separation cone preferably is located partially within the open cyclone bottom. However, catalyst separation tubes also may be located within the separator or external to the separator along the cylindrical axis of the separator as long as they can direct incoming stripping gases into the central region of the separator without significantly disturbing the countercurrent flow of spent catalyst.

Figure 4:
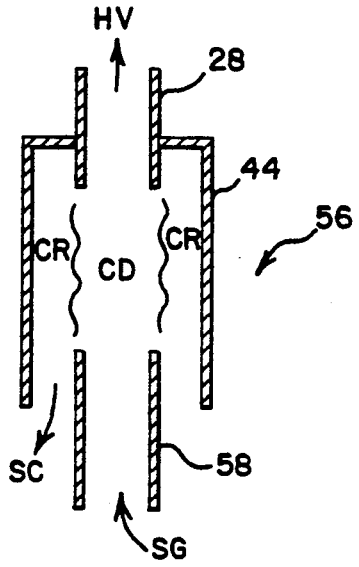
FIGS. 4, 5 and 6 are sectional views of other embodiments of open-bottomed cyclones having catalyst separation tubes.
Figure 5:
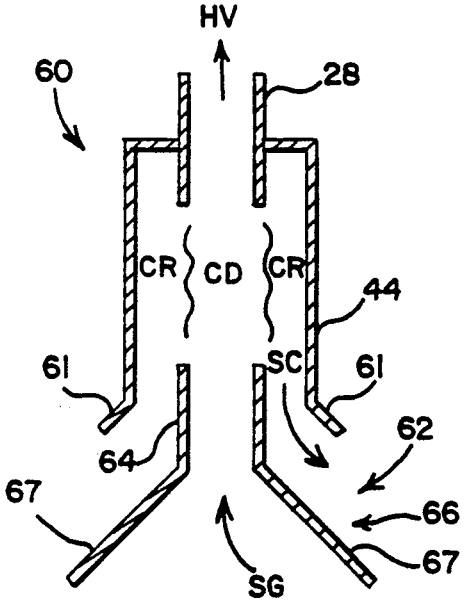
Figure 6:
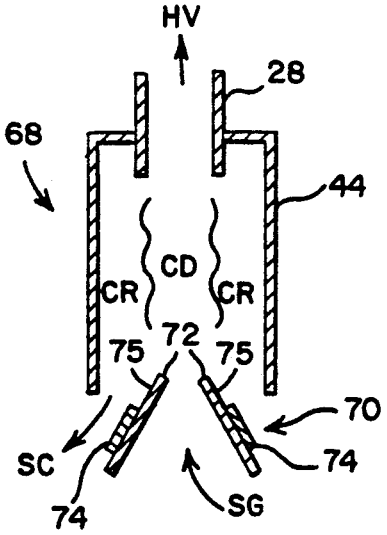

While the shape of cones 40 and 52 is preferred, many of the aforementioned advantages can be accomplished through the use of the catalyst separation tubes illustrated in FIGS. 4, 5 and 6.

In FIG. 4, an open-bottomed cyclone separator 56 includes a cylindrical catalyst separation tube 58. While tube 58 does not provide the preferred conical form, tube 58 nevertheless isolates downwardly swirling catalyst from upwardly moving stripping gas, thereby providing improved performance over a separator lacking any type of catalyst separation tube or cone.

In FIG. 5, a skirted open bottomed cyclone separator 60 includes a skirted lower wall member 61 attached to cylindrical wall member 44 and a separation cone 62 having an upper cylindrical portion 64 and a lower portion 66 including outer inclined surfaces 67. Skirted wall member 61 provides a flared surface that allows flow of separated catalyst SC adhering to cylindrical wall member 44 to move outwardly and downwardly, thereby directing the attached flow further away from the region of upwardly moving stripping gas SG. The lower portions of other separator embodiments already discussed similarly can be skirted if desired with or without the use of a complimentarily shaped inclined separation tube surface as shown in FIG. 5.

Finally, in FIG. 6, an open-bottomed cyclone separator 68 includes a simple conical separation cone 70 having a constantly inclined wall 72. Wall 72 includes a plurality of vertical ribs 74 mounted around cone 72 and an outer cone surface 75. Ribs 74 disrupt any flow of catalyst flow SC attached to cone outer surface 75, thereby allowing attached catalyst flow to move from surface 75 and further away from incoming stripping gas SG. While vertical ribs are shown, virtually any type of protrusion on surface 75 can be used to disrupt attached catalyst flow. It should also be noted that while the simple conical tube form shown in this embodiment provides improved cyclone performance over cyclones lacking a catalyst separation tube, the choice of a simple conical form prevents cone 70 from extending upwardly into the cyclonic vortex of separator 68 to any significant degree, and therefore may result in some mixing of stripping gas with separated solids in the region just above the apex of cone 70.

It should be understood that while FIGS. 1–6 illustrate the preferred vertically oriented embodiments of the invention, the centrifugal forces generated in the separation process typically exceed gravitational forces by several orders of magnitude, thereby permitting the invention to operate successfully in many non-vertical orientations. Additionally, while the embodiments described in conjunction with FIGS. 1–6 are particularly suited for separating spent catalyst from cracked hydrocarbon vapors, the invention can yield improved cyclone performance in any system where a process gas must be passed into an open-ended cyclone separator countercurrently to an outward flow of separated solids. Therefore, the scope of the invention is intended to be limited only by the following claims.

What is claimed is:

1. A cyclone separator for separating spent catalyst from a reaction mixture of spent catalyst and cracked hydrocarbon vapors comprising:

a separation chamber having an open bottom end, a generally cylindrical chamber wall member that is generally cylindrical about a chamber axis and runs from the open bottom end to an upper chamber end, and a chamber top member connected to an upper end of the wall member for substantially enclosing an upper chamber end;

a finder tube having a lower finder tube member extending into the chamber upper end through the chamber top for withdrawing a catalyst-depleted gas from a catalyst-depleted central region of the chamber;

a reactor discharge pipe connected to the separation chamber near the top end of the chamber, and oriented to direct reaction mixture tangentially against the wall member to impart cyclonic flow to the mixture thereby causing cyclonically rotating spent catalyst to separate from the mixture and to rotate downwardly in a catalyst-rich region near the chamber wall member; and an open-ended catalyst separation tube located generally along the chamber vertical axis and within the open chamber bottom for directing downwardly moving catalyst away from the chamber open bottom while simultaneously directing stripping gas into the catalyst-depleted central region of the chamber, said separator tube including an outer tube surface incorporating means for disrupting a flow of spent catalyst attached to the outer tube surface.

2. A cyclone separator for separating spent catalyst from a reaction mixture of spent catalyst and cracked hydrocarbon vapors comprising:

a separation chamber having an open bottom end, a generally cylindrical chamber wall member that is generally cylindrical about a chamber axis and runs from the open bottom end to an upper chamber end, and a chamber top member connected to an upper end of the wall member for substantially enclosing an upper chamber end;

a finder tube having a lower finder tube member extending into the chamber upper end through the chamber top for withdrawing a catalyst-depleted gas from a catalyst-depleted central region of the chamber;

a reactor discharge pipe connected to the separation chamber near the top end of the chamber, and oriented to direct reaction mixture tangentially against the wall member to impart cyclonic flow to the mixture thereby causing cyclonically rotating spent catalyst to separate from the mixture and to rotate downwardly in a catalyst-rich region near the chamber wall member; and an open-ended catalyst separation tube located generally along the chamber vertical axis and within the open chamber bottom for directing downwardly moving catalyst away from the chamber open bottom while simultaneously directing stripping gas into the catalyst-depleted central region of the chamber, said separator tube including a swirl vane for swirling stripping gases passing upwardly through the tube.

3. A method for separating spent catalyst from a reaction mixture of spent catalyst and cracked hydrocarbon vapors comprising the steps of:

discharging the reaction mixture from the upper end of a riser reactor;

introducing the discharged mixture into a generally cylindrical open-ended cyclone separator to cyclonically swirl the mixture;

withdrawing a catalyst-depleted gas from a catalyst-depleted central region of the separator;

allowing catalyst to cyclonically separate from the mixture into a solids-rich region of the separator located near a wall member of the separator;

passing the spent catalyst outwardly through the open chamber end over a catalyst separation tube and into a disengagement vessel surrounding the separation chamber while simultaneously passing a stripping gas from the separator chamber inwardly through the tube toward the catalyst-depleted central region of the separator, said tube having an outer cone surface including means for disrupting spent catalyst flow attached to the outer surface.

4. A method for separating spent catalyst from a reaction mixture of spent catalyst and cracked hydrocarbon vapors comprising the steps of:

discharging the reaction mixture from the upper end of a riser reactor;

introducing the discharged mixture into a generally vertical cylindrical open-ended cyclone separator to cyclonically swirl the mixture;

withdrawing a catalyst-depleted gas from a catalyst-depleted central region of the separator;

allowing catalyst to cyclonically separate from the mixture into a solids-rich region of the separator located near a wall member of the separator;

passing the spent catalyst outwardly through the open chamber end over a catalyst separation tube having a plurality of conical tube portions of successively decreasing radius and into a disengagement vessel surrounding the separation chamber while simultaneously passing a stripping gas from the separator chamber inwardly through the tube toward the catalyst-depleted central region of the separator.

5. A method for separating spent catalyst from a reaction mixture of spent catalyst and cracked hydrocarbon vapors comprising the steps of:

discharging the reaction mixture from the upper end of a riser reactor;

introducing the discharged mixture into a generally cylindrical open-ended cyclone separator to cyclonically swirl the mixture;

withdrawing a catalyst-depleted gas from a catalyst-depleted central region of the separator;

allowing catalyst to cyclonically separate from the mixture into a solids-rich region of the separator located near a wall member of the separator;

passing the spent catalyst outwardly through the open chamber end over a catalyst separation tube and into a disengagement vessel surrounding the separation chamber while simultaneously passing a stripping gas from the separator chamber inwardly through the tube over a swirl vane located within the tube toward the catalyst-depleted central region of the separator to impart cyclonic motion to the stripping gas.

6. A method for separating spent catalyst from a reaction mixture of spent catalyst and cracked hydrocarbon vapors comprising the steps of:

discharging the reaction mixture from the upper end of a riser reactor;

introducing the discharged mixture into a generally cylindrical open-ended cyclone separator to cyclonically swirl the mixture;

withdrawing a catalyst-depleted gas from a catalyst-depleted central region of the separator;

allowing catalyst to cyclonically separate from the mixture into a solids-rich region of the separator located near a wall member of the separator;

passing the spent catalyst outwardly through the open chamber end over a catalyst separation tube having a flared lower chamber wall member outwardly into a disengagement vessel surrounding the separation chamber while simultaneously passing a stripping gas from the separator chamber inwardly through the tube toward the catalyst-depleted central region of the separator.

* * * * *